US005971486A

United States Patent [19]

Petre

[11] Patent Number: 5,971,486

[45] Date of Patent: Oct. 26, 1999

[54] SUPPORTIVE LEG CUSHION

[76] Inventor: Ralph J. Petre, W151 N5276 Plata Ct., Menomonee Falls, Wis. 53051

[21] Appl. No.: 09/050,805

[22] Filed: Mar. 30, 1998

[51] Int. Cl.[6] ..... A47C 16/00

[52] U.S. Cl. ..... 297/423.4; 297/423.39; 297/423.41; 297/188.01

[58] Field of Search ..... 297/423.14, 188.01, 297/188.2, 188.06, 423.1, 423.18, 423.39, 423.41, 423.4

[56] References Cited

U.S. PATENT DOCUMENTS

| | | | |
|---|---|---|---|
| 1,981,148 | 11/1934 | Muench | 297/423.39 |
| 2,100,261 | 11/1937 | Montgomery | 297/188.06 X |
| 2,346,629 | 4/1944 | Travers | 297/188.01 X |
| 2,614,613 | 10/1952 | Bushong | 297/423.39 |
| 2,781,827 | 2/1957 | Bell | 297/423.39 |
| 3,005,662 | 10/1961 | Emery | 297/423.39 |
| 4,213,649 | 7/1980 | Sell | 297/188.01 |
| 5,354,116 | 10/1994 | May | 297/85 |
| 5,419,611 | 5/1995 | Cook | 297/85 |
| 5,593,212 | 1/1997 | Praria | 297/423.44 |
| 5,735,573 | 4/1998 | Vredevoogd | 297/188.01 X |

FOREIGN PATENT DOCUMENTS

| | | | |
|---|---|---|---|
| 25786 | 5/1923 | France | 297/423.4 |
| 2503665 | 8/1976 | Germany | 297/423.39 |

*Primary Examiner*—Laurie K. Cranmer

[57] ABSTRACT

A supportive leg cushion for substantially supporting the knee-joint area of a sitting human with legs extended to a footrest. The supportive leg cushion includes an asymmetrical platform member having opposing sloped surfaces, joined to form a crown or arch. The configuration causes positive and elevated support to the knee-joint area of the user. The asymmetrical platform is attached to the under-surface of a supple cushion. A rack mounted to the side of furniture stows two leg cushion assemblies.

4 Claims, 5 Drawing Sheets

SUPPORTIVE LEG CUSHION

BACKGROUND—FIELD OF THE INVENTION

This invention relates to a two-component leg cushion which provides independent support to the knee-joint area of a sitting human with legs extended to a footrest, and a mountable rack for stowage.

BACKGROUND—DESCRIPTION OF PRIOR ART

Recliner-type chairs and other motion furniture often have non-supportive areas under a user's knee-joint area when the mechanical footrest is fully extended.

Working within the confines of mechanical designs, manufacturers devise forms and methods that address the voids, gaps, and non-supportive areas between the front edge of the seat and the rear edge of the extended footrest.

One approach is the pad-over-chaise recliner, where a continuous upholstered pad flows from the seat, over the inherent void and gap area, and onto the extended footrest. Slight downward pressure to the void and gap area reveals little positive support to the user's knee-joint area. Once the padding materials become slightly matted down, this design serves as little more than a barrier to prevent objects from falling into the mechanical apparatus.

Other designs of motion furniture have been proposed. For example, U.S. Pat. No. 5,354,116 (1994) to May-Rogers and U.S. Pat. No. 5,419,611 (1995) to Cook offer an intermediate padded member that articulates between the seat and fully extended primary footrest. Such an intermediate member lies in substantially the same plane as the seat and does not provide an elevated positive support to the knee joint specifically. The seating plane changes as cushioning and padding materials mat down.

Additionally, users settle into chairs differently due to varying body weights. Often the angle formed by a user's legs to the horizontal plane differ considerably from person to person, as well as from chair to chair. Therefore, motion furniture provides limited positive knee joint support to consumers with special leg needs.

Still other designs of motion furniture have an open space between the seat and extended footrest, leaving the articulating mechanical apparatus fully exposed. Voids, gaps and subsequent lack of support can be detrimental to persons with arthritic leg conditions, job or sports-related leg injuries.

U.S. Pat. No. 5,593,212 (1997) to Praria describes a foot stool extension. This design is not applicable to extended mechanical footrests, but is attachable to a separate foot stool.

Objects and Advantages

Several objects and advantages of the present invention are:

(a) to provide supportive leg cushions that independently bridge the voids, gaps, and non-supportive areas common to motion furniture when the footrest is fully extended;

(b) to provide supportive leg cushions that create a slight elevation to a user's knee-joint area and create positive support and minimal stress to that area;

(c) to provide supportive leg cushions that are adaptable and accommodating to a broad spectrum of human body heights and weights;

(d) to provide supportive leg cushions that are lightweight;

(e) to provide supportive leg cushions that are easy to handle;

(f) to provide asymmetrical platforms with attractive textured areas that are not slippery;

(g) to provide asymmetrical platforms with top surfaces receptive to adhesive materials;

(h) to provide supple cushions that readily attach to the asymmetrical platforms;

(i) to provide a mountable rack for convenient stowage of two supportive leg cushions at side of the furniture;

(j) to provide component parts that can be produced economically.

Still further objects and advantages will become apparent from a consideration of the ensuing description and illustrations.

ILLUSTRATION FIGURES

SUMMARY

In accordance with the present invention a supportive leg cushion to provide substantial support to the knee-joint area of a sitting human with legs extended to a footrest. The supportive leg cushion includes a rigid asymmetrical platform having opposing, sloped surfaces that are joined to form a crown or arch. The configuration causes positive, elevated support to a user's knee-joint area. The rigid asymmetrical platform is attached to the undersurface of a supple cushion. A rack mounted to the side of furniture stows two supportive leg cushions.

The principles of the invention will be discussed further with references to the preferred embodiments. The specifics illustrated exemplify, rather than limit, aspects of the invention as defined in the claim.

Description—FIGS. 1 to 8

Figure 1:
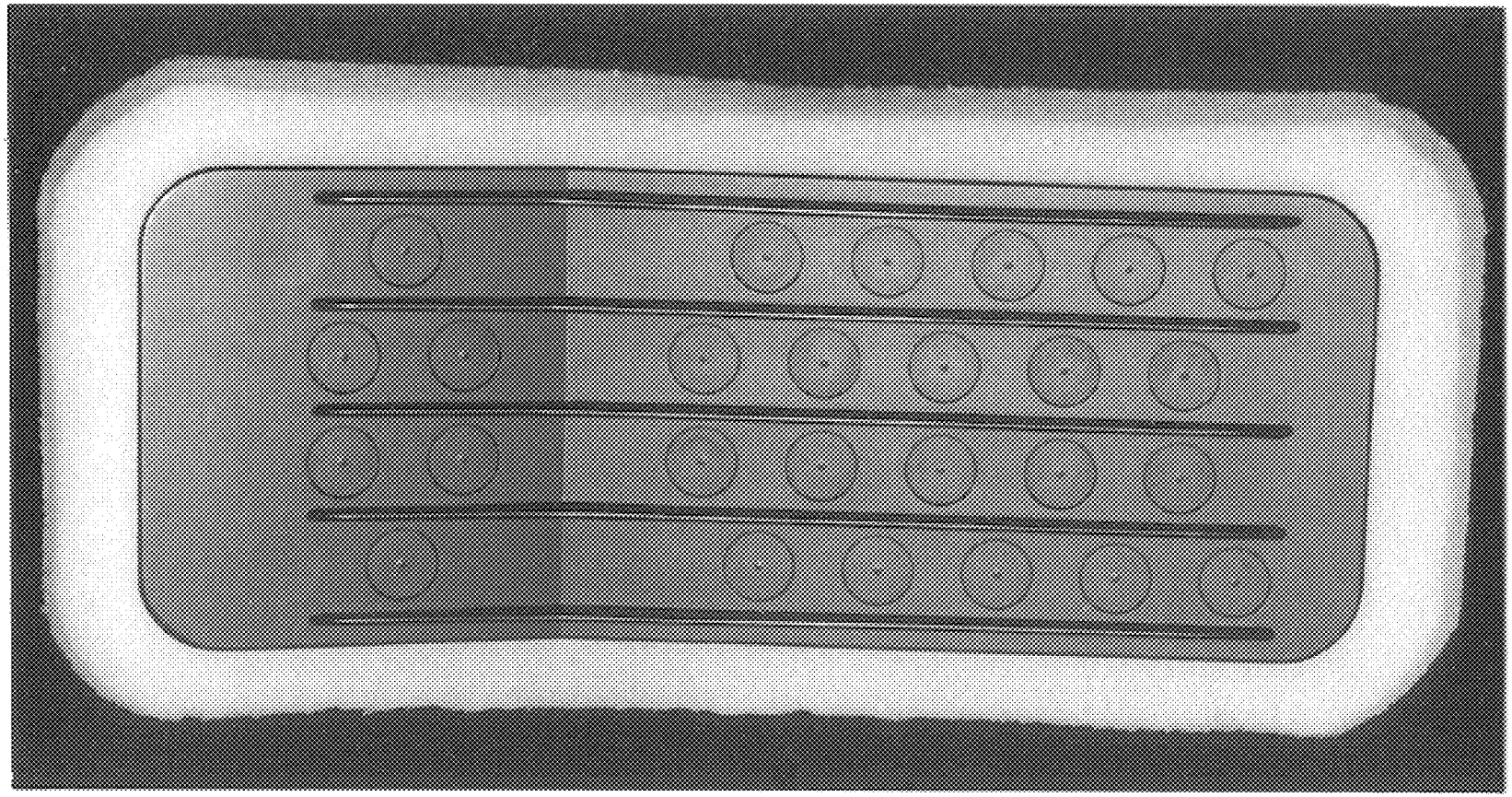
FIG. 1 shows an undersurface view of a supportive leg cushion assembly.

FIG. 1 generally illustrates the undersurface of a supportive leg cushion. The supportive leg cushion includes two parts and an adhesive for bonding the parts together. One part is a rigid asymmetrical platform. The second part is a soft, supple cushion. The platform is disposed to allow cushion overlap around the platform perimeter and is fastened to the undersurface of the cushion. The completed assemblies are used in pairs and are identical. Each cushion assembly adapts to either right or left leg.

The asymmetrical platform, hereinafter called "platform", consists of two opposing sloped surfaces joined to form a crown or arch which supports a user's knee-joint area. A plurality of ribs at spaced locations are attached to the undersurface of the platform strengthen the sloped surfaces, serve as convenient finger grips for handling purposes, and controls lateral movement when in use. The platform has a plurality of elongated ribs of equal length, said ribs being joined longitudinally to the undersurface of the platform parallel to a human leg when in use, the ribs form greater mass at the crown or arch of said undersurface before tapering to their ends. All edges of the platform are rounded. Additionally, circular or other shallow-shaped depressions lighten the platform weight.

In the preferred embodiment the platform is made of injection molded plastic. Additionally, the platform has a textured undersurface that resists slippage when handled, and has smooth top surfaces that readily accept adhesives. However, the platform can consist of any other material capable of supporting loads and repeated stresses without fracturing. These materials include vinyl, nylon, wood, masonite, laminated fibrous materials, various plastic materials, or any combination of such materials.

Figure 2:
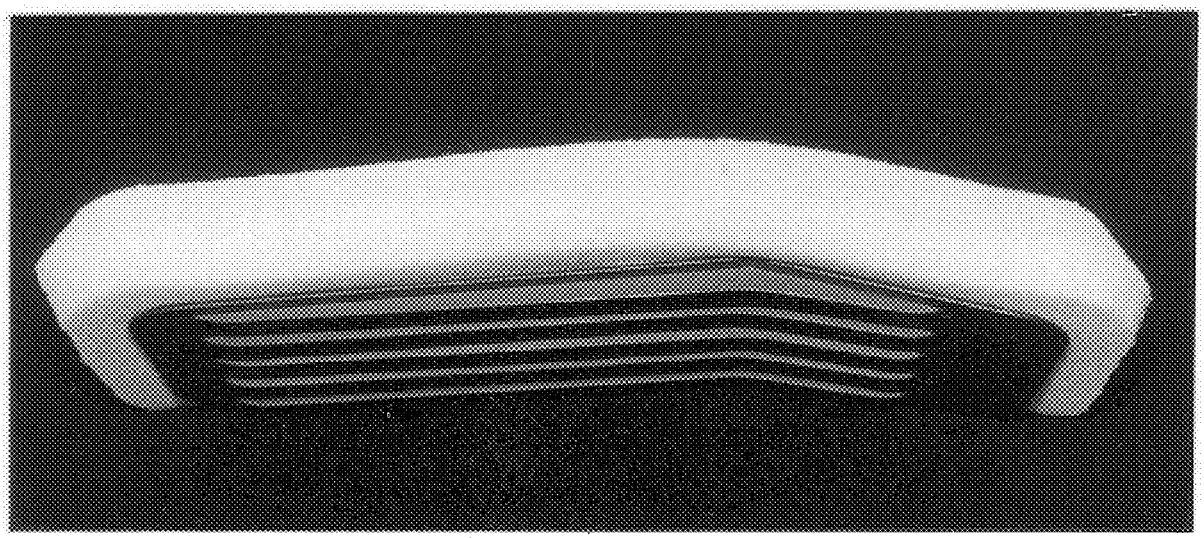
FIG. 2 shows a side profile of cushion and attached rigid support platform with elongated ribs.

FIG. 2 illustrates the elongated asymmetrical ribs being integral to the contiguous sloped surface of the platform. The attached cushion forms a gentle arch. The wedge-shaped edges of the cushion provide for easy handling and positioning.

Figure 3:
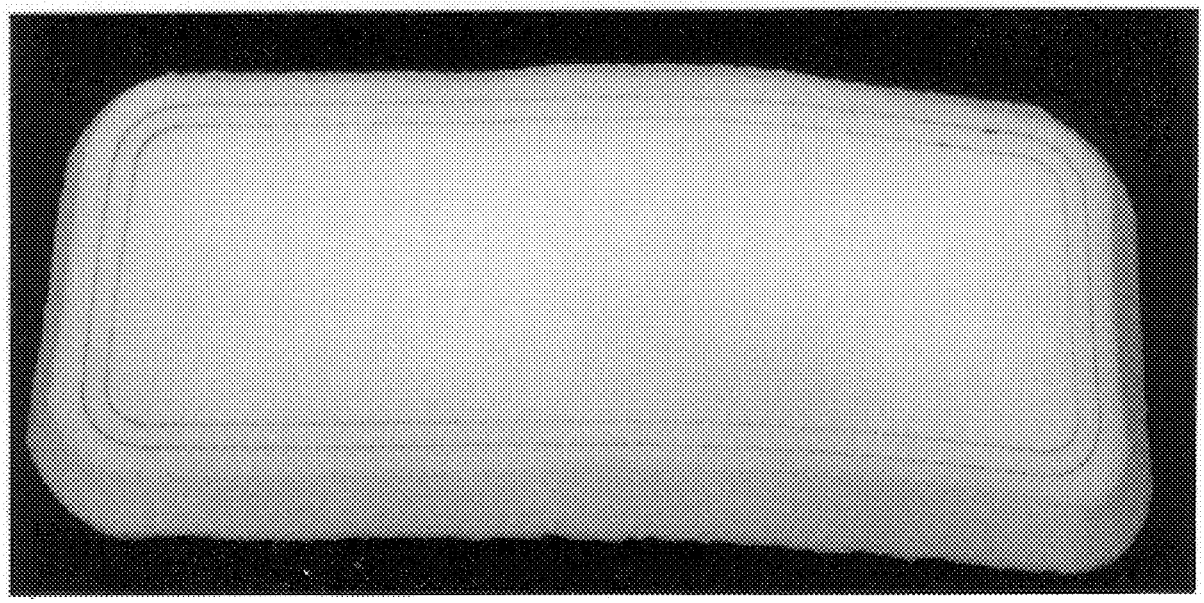
FIG. 3 shows a top view of the cushion.

FIG. 3 illustrates a top view of the cushion. In the preferred embodiment the cushion is polyurethane molded under controlled processing conditions with material additives to form a skin on the surface and a supple texture.

Figure 4:
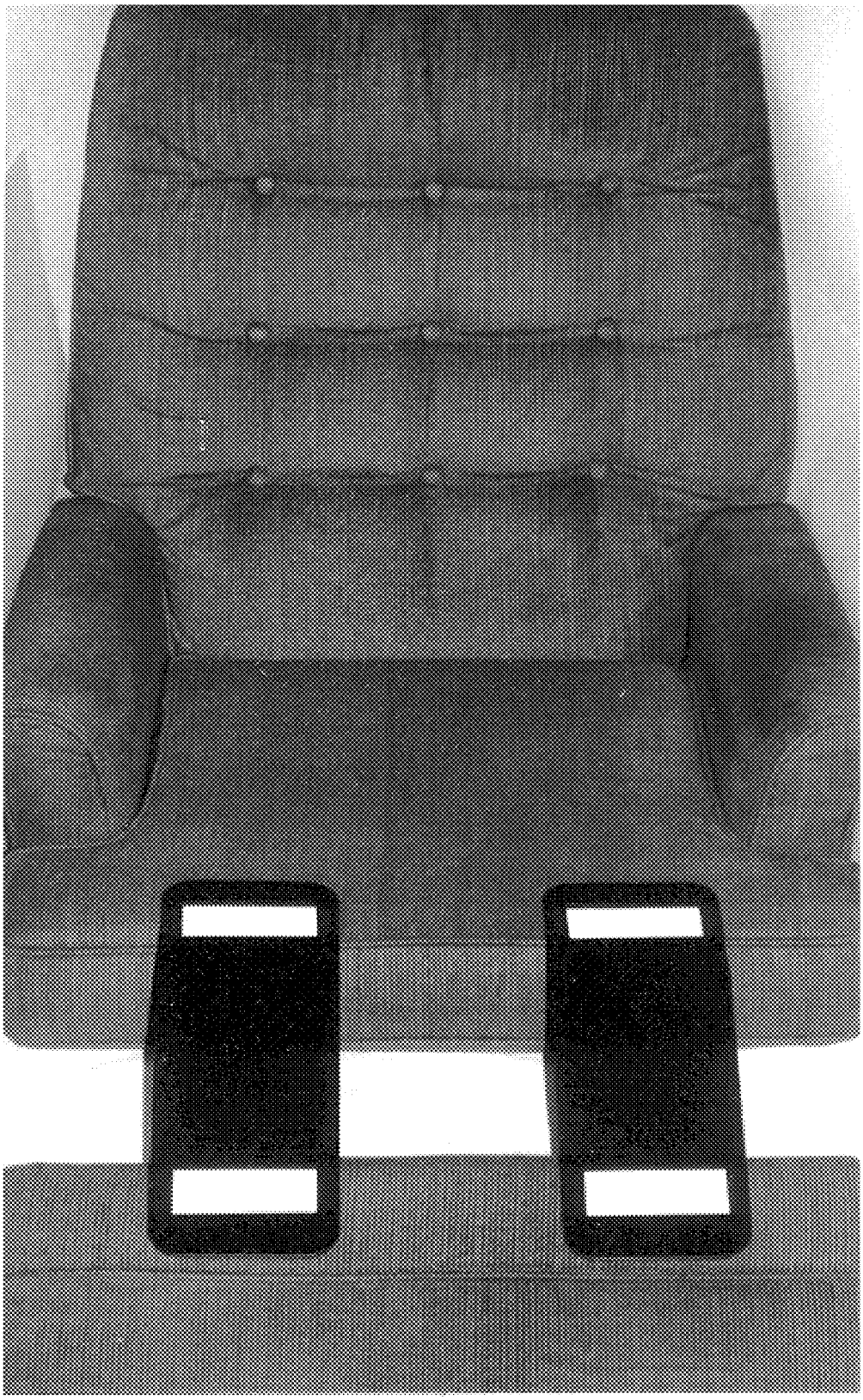
FIG. 4 shows the bridging affect of the rigid support platforms with defined adhesive areas in a typical chair and footrest application.

FIG. 4 illustrates a pair of platforms in a typical upholstered chair with footrest. The overall length of the platform provides overlaps on a seat cushion and footrest. The application creates an arch over the voids, gaps and non-supportive areas. The arch of the platform is positioned beneath the user's knee-joint area. Slight adjustments laterally, forward or back, provide accommodation to a broad spectrum of human body heights and weights. The flexibility of adjustments further allows for a myriad of seating configurations. The illustration also shows the smooth upper surface of the platform which is conducive to adhesive application.

Custom-made platforms may be crafted to a user's specific hip-to-knee measurement. The measurement is taken while the user sits with legs extended to a footrest. The crown or arch of the platform is ideally located and formed to lie beneath the user's knee-joint area. The overall length of the platform allows for overlaps that rest on a seat cushion edge and a footrest edge.

By adjusting the platform laterally, forward or back, the crown or arch can be positioned to ergonomically accommodate a variety of body heights. This also allows for adaptation to an array of articulated motion furniture designs and mechanical apparatus configurations. Unusually tall persons may be accommodated by reversing the supportive leg cushion assembly, thereby extending the crown or arch considerably.

Two adhesive bonding areas are shown as white rectangles on the platforms. A bonding adhesive secures the cushion to the platform. In the preferred embodiment pressure-sensitive double-faced tape is used to permanently secure the platform to the molded skin-surfaced cushion.

In instances where upholstered cushions are preferred, hook-and-loop strips are sewn to the cushion cover with mating adhesive hook-and-loop strips applied to the platform. This technique allows detachments.

Figure 5:
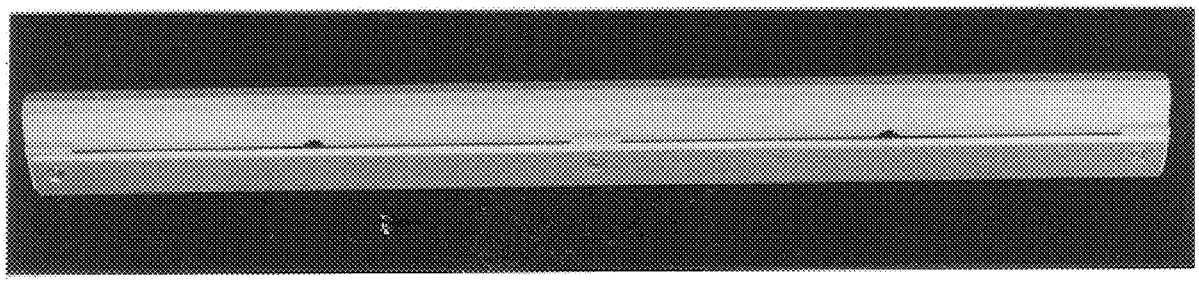
FIG. 5 shows an assembled stowage rack.

FIG. 5 illustrates an assembled stowage rack with two angled receiver slots. The stowage rack includes a mounting board with two angular notches and a thin L-shaped face plate. In the preferred embodiment, the stowage rack is fastened to the furniture frame with two screws. The rack provides convenient stowage for two supportive leg cushions.

Figure 6:
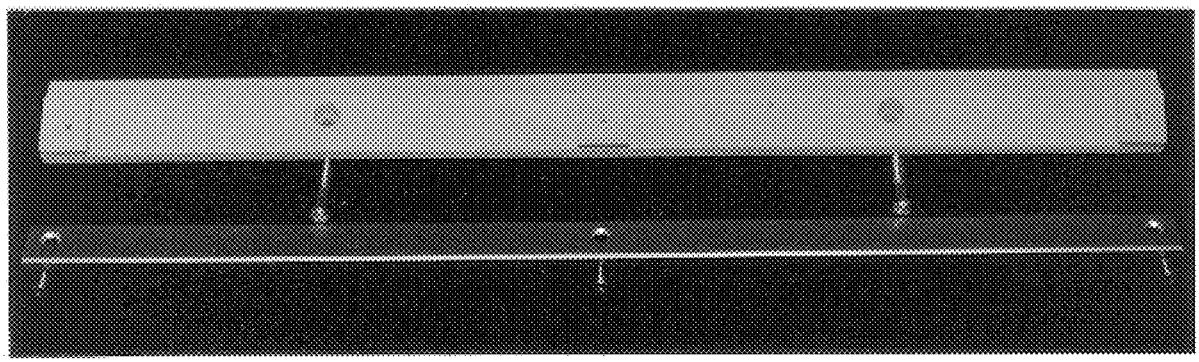
FIG. 6 shows an exploded view of a stowage rack.

FIG. 6 illustrates an exploded view of the stowage rack. The mounting board has two notched areas positioned between three projecting rest pads. Said rest pads occur on the angular front area of the board. Two counter-bored screw holes are provided for fastening said board to a side of furniture. An L-shaped faceplate of predetermined size rests on, and is abutted to, the bottom edge of the rest pads. Said faceplate has three holes. Three screws secure the faceplate to the mounting board. The assembled parts form two angular receiver slots. In the preferred embodiment the mounting board is injected molded plastic. In the preferred embodiment the faceplate is extruded aluminum.

Figure 7:
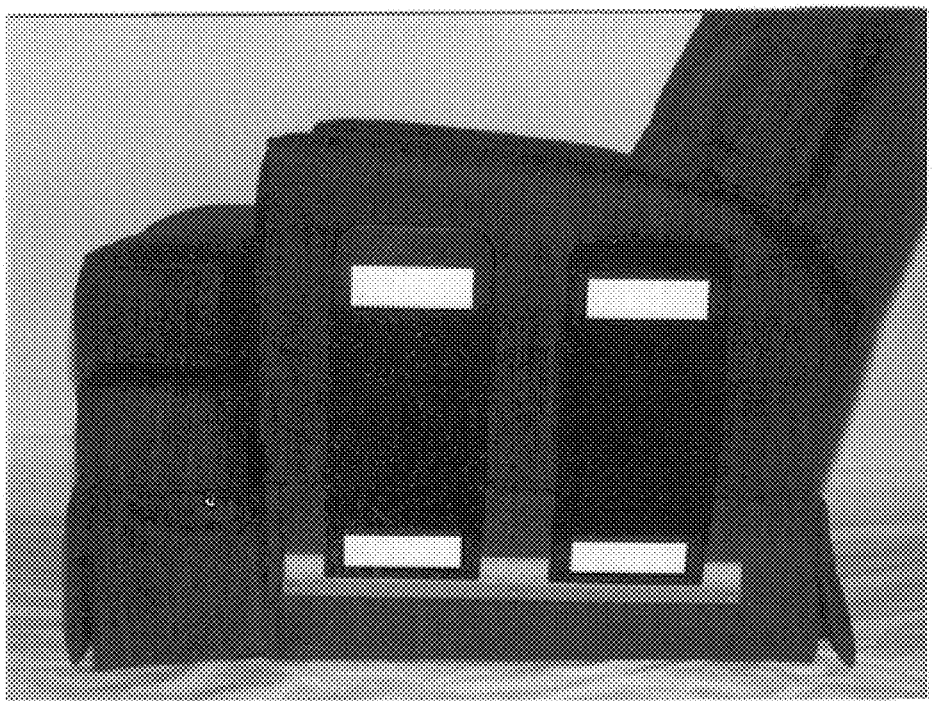
FIG. 7 shows a mounted stowage rack with two rigid support platforms with adhesive areas.

FIG. 7 illustrates the stowage rack mounted to the side of a chair in a typical application. Two platforms are shown in a normal stowage position to demonstrate the function of the angular receiver slots. The white adhesive areas on the rigid platforms demonstrate their critical locations in relationship to the stowage rack. In this position, there is no interference with the integrity of the leg cushion assembly.

Figure 8:
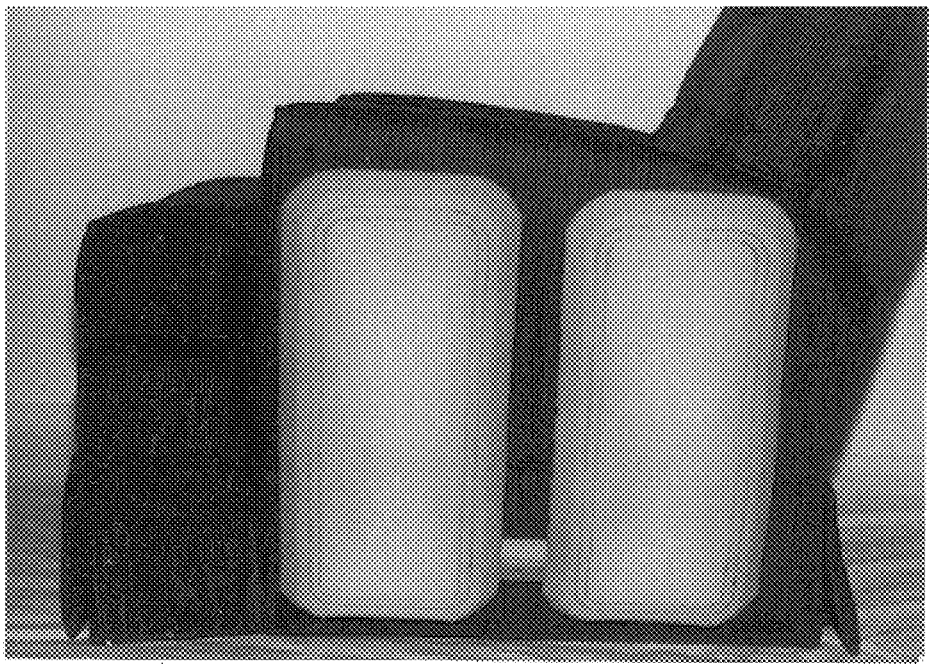
FIG. 8 shows two complete supportive leg cushions in stowage.

FIG. 8 illustrates the stowage rack with two supportive leg cushion assemblies in stowage. The angular receiver slots of the stowage rack compliment the angular configuration of the platforms. The resulting stance of the stowed cushions creates a space between the furniture's arm and the cushions, allowing unimpeded use of the furniture-arm area. In situations where exceptionally wide furniture arms are encountered, the cushions are stowed in the opposite direction.

The invention has been illustrated and described in what is considered to be the most practical and preferred embodiment. It is recognized, however, that departures may be made therefrom within the scope of the invention and that obvious modifications will occur to a person skilled in the art.

Operation

Use of the supportive leg cushion follows usual procedure for using motion furniture, namely, to be sitting and fully extend the mechanical footrest.

Then, (a)lift leg and draw knee slightly towards torso;

(b)position supportive leg cushion beneath knee-joint area;

(c)repeat for other leg;

(d)to exit chair, remove supportive leg cushions before retracting footrest;

(e)stow supportive leg cushions in rack (FIG. 8).

Conclusion, Ramifications, and Scope

The supportive leg cushion can easily accommodate a wide range of body heights and weights. In addition, convenient and safe stowage is provided.

Although the description above contains many specifications, they should not be construed as limiting the scope of the invention, but merely provide illustrations of some presently preferred embodiments. For example, the straight flat sections of the rigid support platform and the straight arch can have other shapes. This might include convex or concave, or any combination of straight, convex, or concave shapes in any direction that join to form a crown or arch. Other possible modifications include:

The overall height of the crown or arch may be varied, thereby increasing or decreasing the elevation beneath the knee-joint area of the user.

A wider platform and cushion assembly to accommodate both legs may be considered where convenience and ease of use is not a concern.

The location of the crown or arch may vary to accommodate a range of body heights.

The cushion may be molded with various depressions or cavities on the undersurface to lessen weight, create varied comforts, and control manufacturing costs.

The side profile of the cushion may be molded to form a crescentic shape, whereby the thinning tapers overlap each end of the platform.

Cushions may be encased in upholstered covers, in which case stock open-cell slab foams or fibrous polyester materials are used.

A process to avoid adhesive applications may be used, whereby the platform becomes affixed directly to the cushion during the molding process.

Although the description above contains many specifications, these should not be construed as limiting the scope of the invention, but merely provide illustrated variations of the preferred embodiments. Thus, the scope of the invention should be determined by the appended claims and their legal equivalent, rather than by the example given.

I claim:

1. A supportive leg cushion for use with upholstered articulated motion furniture with an extendable footrest, comprising:

a rigid platform of asymmetrical form and predetermined size wherein said platform includes opposing sloped surfaces that are joined to form a crown or arch;

a plurality of elongated ribs joined longitudinally to the undersurface of said platform, the ribs forming greater mass at the crown or arch of the undersurface before tapering to their ends;

a cushion of predetermined cross-sectional size and shape;

means to bond said cushion to the top surface of said platform, whereby said supportive leg cushion elevates and supports the knee-joint area of a sitting human by bridging voids, gaps and non-supportive areas between the bottom seat cushion front edge and the extended footrest of upholstered articulated motion furniture and that may be easily adjusted laterally, forward or back, to accommodate a large range of human body heights and weights.

2. The supportive leg cushion of claim 1 further including a rack of predetermined shape and size for attachment to said motion furniture, for stowing two supportive leg cushions on a side of furniture.

3. The supportive leg cushion of claim 2 wherein said rack has a mounting board with two angled notches.

4. The supportive leg cushion of claim 3 wherein a faceplate is attached to said mounting board that spans said notches to form two angular slots.

* * * * *